United States Patent [19]

Nishimoto

[11] Patent Number: 4,754,298

[45] Date of Patent: Jun. 28, 1988

[54] DISC FILM DEVELOPING TREATMENT APPARATUS

[75] Inventor: Kanichi Nishimoto, Wakayama, Japan

[73] Assignee: Noritsu Kenkyu Center Co., Ltd., Wakayama, Japan

[21] Appl. No.: 61,970

[22] Filed: Jun. 15, 1987

[30] Foreign Application Priority Data

Jun. 24, 1986 [JP] Japan ..... 61-95369[U]

[51] Int. Cl.[4] ..... G03D 3/02

[52] U.S. Cl. ..... 354/299; 354/323; 354/324; 354/330

[58] Field of Search ..... 354/299, 320, 321, 322, 354/323, 324, 329, 330

[56] References Cited

U.S. PATENT DOCUMENTS

| | | | |
|---|---|---|---|
| 3,890,629 | 6/1975 | Huss | 354/323 |
| 4,350,429 | 9/1982 | Slavin | 354/299 |
| 4,456,355 | 6/1984 | Kaufmann et al. | 354/299 |
| 4,502,772 | 3/1985 | Mihara | 354/322 |
| 4,655,575 | 4/1987 | Murakami | 354/330 |

*Primary Examiner*—A. A. Mathews

*Attorney, Agent, or Firm*—Larson & Taylor

[57] ABSTRACT

A hot water bath having a constant temperature device for heating a plurality of treatment liquids in a plurality of treating liquid storing baths to a temperature suitable for developing disc films such as a specified temperature or the like is communicated with another hot water bath surrounding a single disc film treating tank by way of water supply pipes and water return pipes. Certain treatment liquid is supplied from the treating liquid storing baths to the disc film treating tank in accordance with a predetermined order and the thus supplied treating liquid is discharged therefrom at every time when an intended treating is completed.

3 Claims, 3 Drawing Sheets

DISC FILM DEVELOPING TREATMENT APPARATUS

BACKGROUND OF THE INVENTION

1. Field of the Invention

The present invention relates to a photosensitive material treatment apparatus, particularly an apparatus for developing disc films as photosensitive material. More particularly, the present invention relates to a disc film developing treatment apparatus which assures that disc films of which consumption is at a relatively lower level at present can be treated by utilizing a part of the treating liquids in a so-called automatic developing apparatus for treating a strip of photosensitive material such as photographic film, printing paper or the like each of which is used widely.

2. Description of the Prior Art

Several years ago, a disc-shaped photographic film that is called disc film of which photographic exposure portions are arranged in an equally spaced relation along the periphery of the disc has been developed as photosensitive material for cameras in place of a strip of photographic film.

As a result of development of disc film, there were already made several proposals as to treating apparatus, treating machines and associated devices usable for carrying out a series of so-called developing treatments for disc films ranging from developing to stabilizing. However, each of the above-mentioned conventional apparatuses, machines and devices is constructed in compliance with the conventional treating process or system for treating a large number of photographic films at a highly increased operational efficiency. Accordingly, employment of the conventional treating process or system is not economically advantageous and is less practical due to the current situation that the amount of consumption of the disc films is still at a relatively low level.

In view of the fact as mentioned above, inventors employed by the same company as the assignee inventor of the present invention developed an apparatus for treating disc films as disclosed in U.S. Pat. No. 4,502,772, or U.S. Pat. No. 4,655,578. However, each of the above-noted prior inventions concerning apparatus, machines and devices is constructed in compliance with the established technical concept for treating a large number of photographic films at highly increased operational efficiency. Accordingly, employment of the conventional treating apparatus, machines and associated devices is not satisfactory in respect of structure and construction, is not economically advantageous and is relatively impractical due to the current situation that consumption of disc film is maintained still at a relatively lower level.

Thus, the applicant of the present invention has made further developments and invented an invention as disclosed in copending U.S. patent application Ser. No. 07/010,421, copending as well as U.S. patent application Ser. No. 07/010,422, both filed Feb. 3, 1987.

SUMMARY OF THE INVENTION

Thus, the present invention has been made with the foregoing background in mind.

A main object of the present invention is to provide a disc film developing treatment apparatus which assures that developing treatment of disc films is achieved with the use of a single treatment tank, although demand for disc films tends to slightly increase year by year but consumption is still at a lower level on the whole.

Another object of the present invention to provide a disc film developing treatment apparatus which makes it possible to maintain a temperature suitable for developing treatment such as a specified temperature or the like without any reduction of temperature of each of treating liquids which are supplied from treating liquid storing baths into a single treating liquid storing bath whereby the highest developing treating effect is obtainable.

Another object of the present invention is to provide a disc film developing treatment apparatus which is designed in small dimensions and simple in structure corresponding to small consumption and size of disc films and which assures that the apparatus is easily handled.

Further, another object of the present invention is to provide a disc film developing treatment apparatus which assures that the apparatus is attached to a conventional long developing apparatus so that a part of structure of the last-mentioned apparatus is in common use for both the apparatuses and which makes it possible to utilize treating liquids in treating liquid baths in the last-mentioned apparatus whereby an area required for installing the apparatus can be reduced and highly economical performance is obtainable.

To accomplish the above objects there is proposed according to the present invention a disc film developing treatment apparatus which comprises a hot water bath having a constant temperature device for heating a plurality of treating liquids in a plurality of treating liquid storing baths to a temperature suitable for developing disc films such as specified temperature or the like, the treating liquids being separately stored in a plurality of treating liquid storing baths, a single disc film treatment tank into which the treating liquids heated to a temperature suitable for developing disc films such as specified temperature or the like are successively introduced from the treating liquid storing baths in accordance with a predetermined order and from which the treating liquids are discharged after completion of treating with the use of the treating liquids which are successively introduced in accordance with the predetermined order, a hot water bath surrounding the single disc film treating tank to heat the latter, and the first-mentioned hot water bath being communicated with the last-mentioned hot water bath by way of supply pipes and return pipes.

Other objects, features and advantages of the present invention will become readily apparent from reading the following description which has been prepared in conjunction with the accompanying drawings.

BRIEF DESCRIPTION OF THE DRAWINGS

The accompanying drawings schematically illustrate a disc film developing treatment apparatus in accordance with a preferred embodiment of the present invention by preparing them to such an extent that they can be easily understood by any expert in the art to which the present invention pertains, although components which could be easily understood by him are not illustrated as far as possible for the purpose of simplification of illustration.

DESCRIPTION OF THE PREFERRED EMBODIMENT

Now, the present invention will be described in a greater detail with reference to the accompanying drawings which schematically illustrate a disc film developing treatment apparatus in accordance with a preferred embodiment thereof wherein the treatment apparatus essentially comprises a combination of a treating unit similar to a conventional treating apparatus for photosensitive material such as a strip of photographic film, printing paper or the like, (for instance, an automatic developing machine which serves as a film processor manufactured and sold under a tradename of QSS by Noritsu Koki Co., Ltd.) and a disc film treating unit for treating a small number of disc films by utilizing a part of each of treating liquids supplied to the aforesaid treating unit. It should be noted that a large number of photographic films, printing papers or the like are consumed but demand for the disc film is relatively limited and therefore only a small number of disc films are consumed at present.

Figure 1:
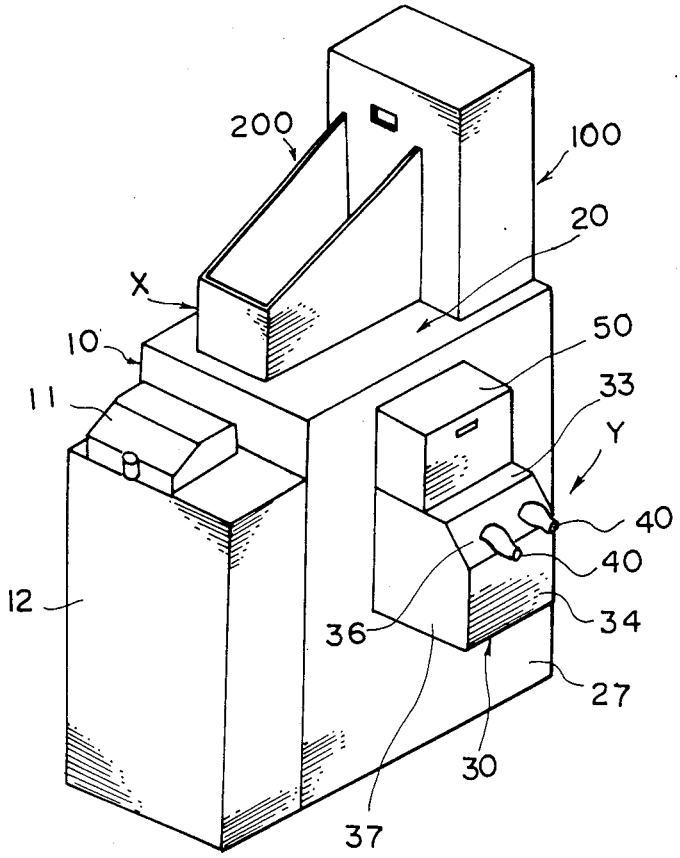
FIG. 1 is a fragmental perspective view of the disc film developing treatment apparatus as seen from the above in the downwardly inclined direction.

First, refering to FIG. 1, a section as identified by reference symbol X is a treating apparatus usable for a strip of photographic film wherein the apparatus comprising an automatic developing treatment section 10 similar to a conventional automatic developing machine for treating a strip of photographic film, (for instance, film processor manufactured and sold under a tradename of QSS by Noritsu Koki Co., Ltd.), a drier 100 for drying a strip of photographic film which has been developed in the developing treatment section 10 and a stacker 200 in which photographic films delivered from the drier 100 are stored. A section, as identified by reference symbol Y, is a disc film developing treatment unit which constitutes an essential part in the apparatus of the invention.

In the automatic developing section 10, reference numeral 20 designates an outer casing including a outer panel as a main component of which fore end includes an insert box 11, a control box 12 or the like. Both the outer casing 20 and the insert box 11 are communicated with one another via a photographic inlet port (which is not shown in the drawings.) On the rear end of the outer casing 20 a photographic film outlet (which is not shown in the drawing) is disposed to be communicated with the drier 100.

Figure 3:
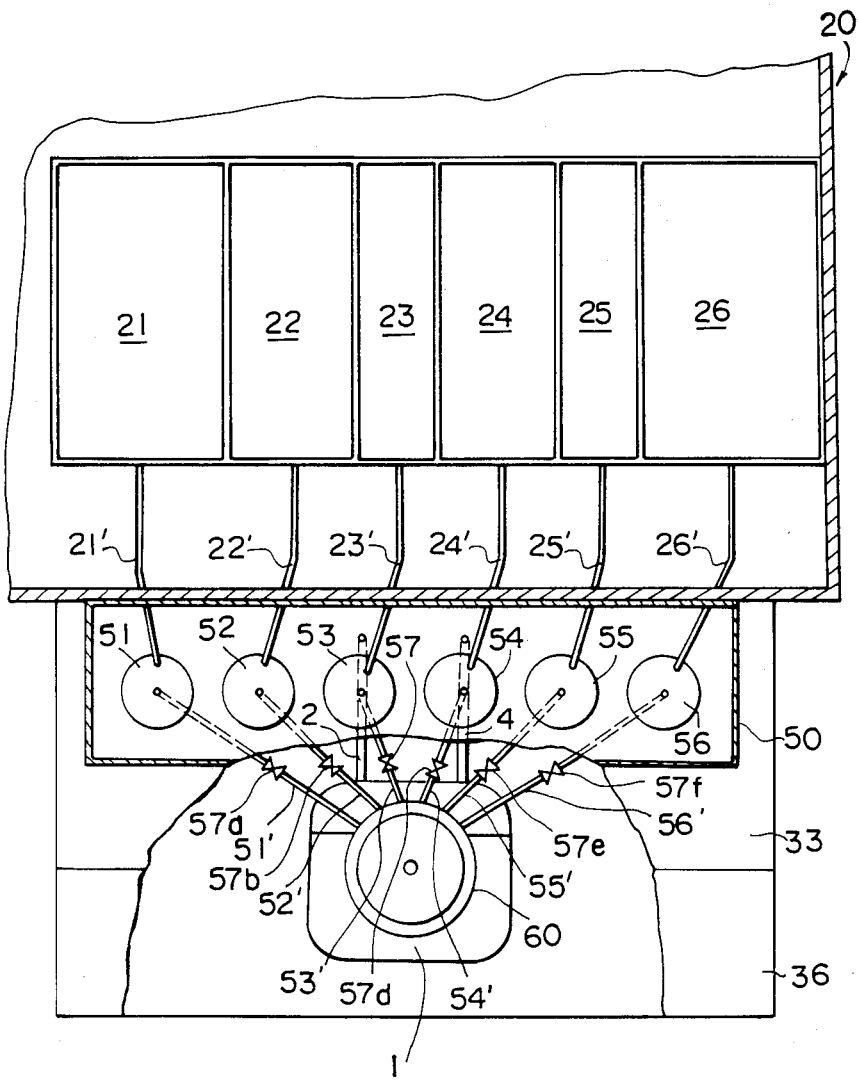
FIG. 3 is a sectional plan view taken in the direction of the arrows along the line A-B in FIG. 2 (and partially broken away) of the apparatus, particularly illustrating essential components constituting the apparatus of the invention.

Further, the outer casing 20 encloses a developing liquid bath 21, a bleaching liquid bath 22, a washing water bath 23, a fixing liquid bath 24, a washing water bath 25 and a stabilizing liquid bath 26 which as seen in FIG. 3 are arranged one after another. Each bath is equipped with a treating liquid adding device and a heating device for maintaining treating liquid at the optimum temperature by heating.

With reference to the disc film developing unit as identified by reference symbol Y, reference numeral 30 designates a dark box attached to a side panel 27 which constitutes an outer casing 20. The dark box 30 includes an inside wall panel 31 attached to the side panel 27, a bottom panel 32, a top wall panel 33 having a width narrower than that of the bottom panel 32, an outer panel 34 having a height lower than the inside wall panel 31, an inclined wall panel 36 by way of which the outer panel 34 is connected to the top wall panel 33 and which has two light sealing sleeves 40 which can be closed to assure light tightness, a trapezoidal fore end panel 37 and a trapezoidal rear end panel 38. Reference numeral 39 designates a L-shaped partition plate of which the horizontal portion is formed with a disc film treating tank fitting hole 41 to be described later. The vertical plate portion of the partition plate 39 is spaced away from the inside wall panel 31. Fore and rear ends of the vertical plate portion of the partition plate 39 are connected to the fore and rear end panels 37 and 38 respectively and the end of the horizontal plate portion is connected to the upper part of the outer panel 34, as shown in FIGS. 2 and 3.

Figure 2:
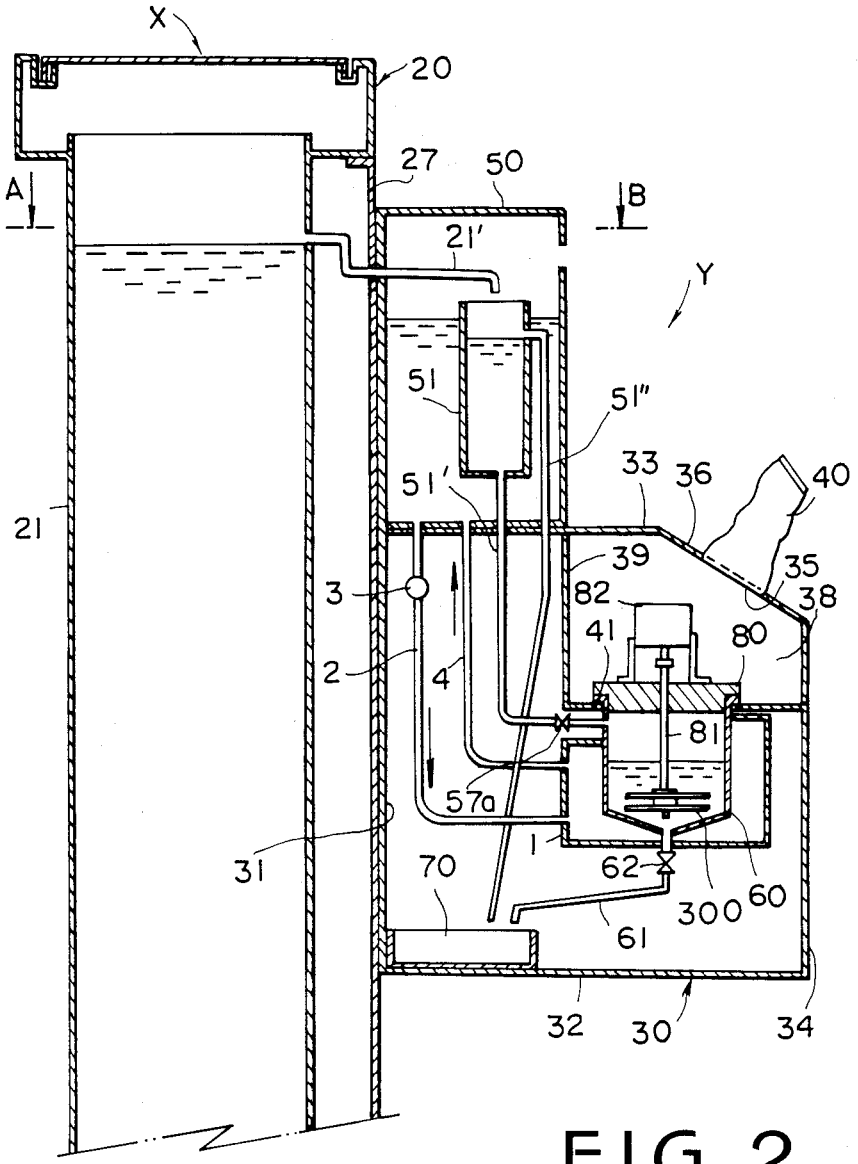
FIG. 2 is a schematic vertical sectional view of the apparatus, particularly illustrating an essential part of the apparatus.

In FIGS. 2 and 3, reference numeral 50 designates a hot water bath which is disposed on the top wall panel 33 of the dark box 30. The hot water bath 50 is provided with an agitating piping (sometimes this is not required) having a recirculating pump disposed midway thereof, thermostat, heater (both of which are not shown in the drawings), a control circuit and a constant temperature device for maintaining each of treating liquids at a predetermined temperature. Further, the hot water bath 50 is provided with overflowed treating liquid storing tanks 51, 52, 53, 54, 55 and 56 into which overflowed liquids from the developing liquid bath 21, the bleaching liquid bath 22, the washing water bath 23, the fixing liquid bath 24, the washing water bath 25 and the stabilizing liquid bath 26 in the automatic developing unit X for a strip of photographic film are separately introduced via overflow pipes 21', 22', 23', 24', 25' and 26'. The overflowed treating liquid storing tanks 51, 52, 53, 54, 55 and 56 are communicated with a disc film treating tank 60 via pipes 51', 52', 54', 54', 55' and 56' extending between the bottom of the aforesaid storing tanks and the disc film treating tank 60 with solenoid valves $57_a$, $57_b$, $57_c$, $57_d$, $57_e$ and $57_f$ interposed therebetween so that a plurality of disc films 300 are subjected to developing, bleaching, water washing, fixing, a water washing and stabilizing separately. Further, overflow pipes 51'', 52'', 53'', 54'', 55'' and 56'' extend from the upper part of the storing tanks 51, 52, 53, 54, 55 and 56 to a waste liquid tank 70 to be described later. It should be noted that overflow pipes 52'' to 56'' are not shown for the purpose of simplification of illustrating.

Further, reference numeral 60 designates a disc film treating tank which is fitted through the disc film treating tank fitting hole 41 in the horizontal plate of the L-shaped partition plate 39. The disc film treating tank 60 is equipped with a solenoid valve 62 at the bottom thereof and a drain pipe 61 extends from the solenoid valve 62 to the waste liquid tank 70 so that, on completion of a certain treatment, treating liquid is drained to the waste liquid tank 70 through the drain pipe 61.

The waste liquid tank 70 is removably placed on the lower part of the dark box 30 so that liquid overflowed from the storing tanks 51, 52, 53, 54, 55 and 56 is drained to the waste liquid tank 70 via the pipes 51'', 52'', 53'', 54'', 55'' and 56'', and disk film treating tank 60 is drained to the waste liquid tank 70 via the drain pipe 61 after completion of a certain treatment.

By controlling the opening and closing of the solenoid valve 62 on the drain pipe 61 as well as the solenoid valves $57_a$, $57_b$, $57_c$, $57_d$, $57_e$ and $57_f$ on the pipes 51', 52', 53', 54', 55' and 56' with the aid of a control circuit (not shown) it is assured that a volume of treating liquid required for initial treatment is properly introduced into the interior of the disc film treating tank 60. After completion of the initial treatment the next treating liquid is introduced into the waste liquid tank 70 and the next treatment is then carried out. The following treatments are successively carried out in the same manner as mentioned above. Namely, timers and other instruments are incorporated in the control circuit so that opening and closing times for solenoid valves and disc film treating times are set as required for each of the following steps.

Reference numeral 80 designates a cap removably fitted to the disc film treating tank 60. A plurality of disc films 300 to be treated are removably supported at the lower part of the disc film supporting spindle 81. The upper part of the support spindle 81 is extended through the central part of the cap 80 so that the spindle 81 is held to be able to rotate or turn reciprocately. The upper end of the spindle 81 is connected the lower end of the rotating shaft of a motor 82 mounted on the cap 80.

Finally, reference numeral 1 designates a closed bath surrounding the outer wall of the disc film treating tank 60 to serve as a hot water bath for heating the disc film treating tank 60. To supply hot water in the hot water bath 50 to the closed bath 1 a hot water supply pipe 2 extends between the bottom of the hot water bath 50 and the side wall of the closed bath 1. Similarly, a hot water return pipe 4 extends between the upper part of the side wall of the closed bath 1 and the bottom of the hot water bath 50.

Incidentally, the hot water bath for the heating the treating tank 60 is identified by reference numeral 1 and described in the form of a closed bath, but in the case where the hot water bath 1 has the same level of liquid as that of the hot water bath 50, it is not necessary that the hot water bath 1 be designed as a closed bath. Further, in the drawing it is shown that the one end of the supply pipe 2 and the one end of the return pipe 4 are opened at the bottom wall of the hot water bath. However, the position where the one end of the supply tube 2 and the one end of the return pipe 4 are opened in the hot water bath 50 may be located about at the middle height of the hot water bath 50.

Since the developing treating apparatus of the invention is constructed in the above-described manner, a strip of photographic film is successively developed in the automatic manner with the use of the developing liquid bath 21, the bleaching liquid bath 22, the washing water bath 23, the fixing liquid bath 24, the washing water bath 25 and the stabilizing bath 26, treating liquids are additionally supplied in each of the above-mentioned baths, their overflowed treating liquids are introduced into the overflowed liquid storing tanks 51, 52, 53, 54, 55 and 56 via overflow pipes 21', 22', 23', 24', 25', and 26' to be stored therein, the thus stored liquids are maintained at a predetermined temperature with the aid of hot water in the hot water bath, and overflowed liquids from the overflow liquid storing tanks 51, 52, 53, 54, 55 and 56 are drained to the waste liquid tank 70 via the overflow pipes 51'', 52'', 53'', 54'', 55'' and 56''.

When disc films 300 are developed, the pump 3 in the disc film treating unit Y is driven to supply hot water in the hot water bath 50 to the closed bath 1 via the delivery pipe 2 and after, the treatment tank 60 in the closed bath 1 is heated by hot water, the latter is returned to the hot water bath 50 via the return pipe 4 whereby the treatment tank 60 is kept in the substantially same temperature as that of each of the overflowed liquid storing tanks 51, 52, 53, 54, 55 and 56. On the other hand, disc films 300 to be treated are fitted onto the lower end part of the disc film supporting spindle 81 in the dark box 30 and thereafter the solenoid valve 62 on the drain pipe 61 is closed by means of the control circuit while the cap 80 is fitted to the disc film treatment tank 60. Then, a properly determined volume of treating liquid required for developing treatment is introduced into the treatment tank 60 from the storing tank 51 by opening the solenoid valve $57_a$ on the liquid delivery pipe 51' with the aid of the control circuit so that developing is effected by rotating the motor 82 for a predetermined period of time. Thereafter, the solenoid valve 62 on the drain pipe 61 is opened so as to allow used treating liquid to be drained to the waste liquid tank 70. Next, the solenoid valve $57_b$ on the delivery pipe 52' is opened and a properly determined volume of treating liquid required for bleaching treatment is introduced into the treatment tank 60 from the storing tank 52 to effect bleaching treatment. Then, fixing treatment and stabilizing treatment are successively carried out in the same manner as mentioned above.

Thus, a small number of disc films can be economically developed by utilizing treatment liquid overflowed from the photographic film treating bath.

Incidentally, description has been made as to the case where the disc film treating unit Y of the invention is attached to a conventional automatic developing unit for a strip of photographic film or the like. However, the present invention should not be limited only to this. Alternatively, the disc film developing treatment unit may be constructed as an independent apparatus so that it can be used as an independent developing treatment unit. Further, in the case where no water is used for developing treatment, components relative to or associated with supplying of washing water to the treatment tank 60 can be omitted.

Further, when the apparatus disclosed in copending U.S. patent application Ser. No. 07/010,422, is employed for developing treatment, the top panel 33 and the inclined side wall panel 36 including the light shielding sleeves 40 can be omitted and developing treatment can be carried out in a bright room.

As will be apparent from the above description, the disc film developing treatment apparatus of the invention constructed in the above-described manner has many advantageous effects as follows; Namely, a single disc film treatment tank is employed for a series of developing treatments in contrast with a conventional apparatus which requires a series of treating liquid baths for a plurality of treating liquids in a long dark box. Since the disc film treatment tank is heated at the substantially same temperature as that of each of treating liquids in the treating liquid baths, there is no fear that a temperature of each of treating liquids delivered to the treating tank is lowered. Thus, a temperature suitable for developing a plurality of disc films can be maintained without any reduction of developing efficiency of the disc films. Thus, it become possible to provide a disc film developing treatment apparatus which is economical and suitable for developing a small number of disc films. Another advantageous effect of the invention is that when the disc film developing treatment apparatus of the invention is attached to a treatment apparatus for treating a strip of photographic film, printing paper or the like, a part of the first-mentioned apparatus is constituted by the last-mentioned apparatus whereby the area required for installing the whole apparatus can be reduced. Further, since treating liquids held in treating liquid baths of the last-mentioned apparatus can be utilized, it becomes possible to provide a disc film developing treatment apparatus which is highly economical.

While the present invention has been described above only with respect to a single preferred embodiment, it should of course be understood that it should not be limited only to this but various changes or modifications may be made in any acceptable manner without departure from the spirit and scope of the invention as defined by the appended claims.

What is claimed is:

1. A disc film developing treatment apparatus in combination with an automatic photosensitive material developing apparatus comprising:

a hot water bath having a constant temperature device for heating a plurality of treatment liquids in a plurality of treating liquid storing baths to a temperature suitable for developing disc films, said treating liquids being separately stored in a plurality of respective treating liquid storing baths;

a single disc film treatment tank into which the treatment liquids heated to a temperature suitable for developing disc films are successively introduced from said treating liquid storing baths in accordance with a predetermined order and from which the treating liquids are discharged after completion of treating with the use of the treating liquids which are successively introduced in accordance with the predetermined order;

a hot water bath surrounding said single disc film treating tank to heat the latter;

the first-mentioned hot water bath being communicated with the last-mentioned hot water bath by way of supply pipes and return pipes; and said disc film developing treatment apparatus being attached to said automatic photosensitive material developing apparatus in a side-by-side relation in such a manner that a plurality of treating liquids in said automatic photosensitive material developing apparatus can be introduced into a plurality of respective developing treatment liquid baths in the disc film developing treatment apparatus, said automatic photosensitive material developing apparatus including a series of treating liquid baths in a dark box for carrying out a series of developing treatments such as developing, bleaching, or fixing for a strip of photosensitive material.

2. The invention of claim 1, wherein each of the treating liquids usable for disc film developing treatment can be introduced to said disc film developing treatment apparatus by overflowing from the automatic developing apparatus in which a series of developing treatments such as developing, bleaching, or fixing are carried out for a strip of photosensitive material.

3. The invention of claim 1, wherein said hot water bath for heating the disc film treatment tank comprises a closed bath.

* * * * *